US005438243A

United States Patent [19]

Kong

[11] Patent Number: 5,438,243

[45] Date of Patent: Aug. 1, 1995

[54] ELECTRONIC BALLAST FOR INSTANT START GAS DISCHARGE LAMPS

[76] Inventor: Oin Kong, 13928 Mustang Hill La., North Potomac, Md. 20878

[21] Appl. No.: 165,644

[22] Filed: Dec. 13, 1993

[51] Int. Cl.[6] ..... H05B 37/02

[52] U.S. Cl. ..... 315/219; 315/224; 315/226; 315/DIG. 5; 315/DIG. 7

[58] Field of Search ..... 315/219, 224, 226, 209 R, 315/250, 282, DIG. 5, DIG. 7

[56] References Cited

U.S. PATENT DOCUMENTS 4,438,372 3/1984 Zuchtriegel ..... 315/224
4,684,851 8/1987 Van meurs ..... 315/224
4,972,124 11/1990 Powers ..... 315/219

*Primary Examiner*—Robert J. Pascal
*Assistant Examiner*—Haissa Philogene
*Attorney, Agent, or Firm*—Graham & James

[57] ABSTRACT

The present invention provide a an electronic ballast for instant start gas discharge lamps that is designed with a limited number of components thereby enabling it to be produced relatively inexpensively and to be operated more efficiently and more reliably. The invention provides quasi-voltage fed, half-bridge parallel resonant inverter. This inverter exhibits a voltage output characteristic in which the output power is inversely proportional to the load. The invention instantly starts in any order the multi-parallel configured gas discharge lamps. This invention balances the output current. This permits increasing the resonant frequency of the inverter to values higher than 50 Khz while maintaining a low crest factor and high efficiency. The invention is directed to a ballast for starting at least one gas discharge lamp, the ballast being composed of: a DC voltage input terminal device for receiving DC power from an external power supply; an inverter device, coupled to the input terminal device, for generating and outputting an alternating output voltage based on the DC power from the input terminal device; a transformer device, coupled to the inverter device, for transferring the alternating output voltage output by the inverter device to the at least one gas discharge lamp; and a ballasting device, coupled to the transformer device and the at least one gas discharge lamp, for limiting the lamp current output by the at least one gas discharge lamp that is passed back to the transformer device.

19 Claims, 2 Drawing Sheets

ELECTRONIC BALLAST FOR INSTANT START GAS DISCHARGE LAMPS

BACKGROUND OF THE INVENTION

Electronic ballast circuits for powering gas discharge lamps have been studied for some time. These circuits, however, have certain drawbacks, as discussed, for example, in U.S. Pat. No. 4,972,124 to Charles D. Powers. In this patent, Powers discloses a circuit which was designed to overcome these drawbacks. However, his circuit is designed for series loads and is not suitable for multi-parallel loads. In Powers' design, a capacitor is used for the ballasting and current limiting element. The use of a capacitor as the ballasting element results in a large imaginary current being fed back to the output transformer requiring the voltampere (VA) rating of this transformer to be large. Consequently, the physical size of the output transformer must also be large, thereby reducing the overall efficiency of the ballast and increasing its cost. The use of a capacitor as the ballasting element also limits the operating frequency of the ballast to approximately 30 Khz, whereas a low crest factor and high efficiency are required.

Gas discharge lamps normally present the powering electronic ballast with a very harsh environment that includes high temperature, and high in-rush voltage and current. Operation for long periods of time in such a harsh environment requires that the electronic ballast be of very robust design. Therefore, in the ballast, the transistor has to be well protected from all kinds of high voltage and high current. In Powers' design there is not enough protection circuitry to reduce the possibility of damage to the transistors. Thus, the reliability of the design is inadequate.

SUMMARY OF THE INVENTION

It is therefore an object of the present invention is to provide an electronic ballast for instant start gas discharge lamps that is designed with a limited number of components thereby enabling it to be produced relatively inexpensively and to be operated more efficiently and more reliably.

A further object of this invention is to provide a quasi-voltage fed, half-bridge parallel resonant inverter. This inverter exhibits a voltage output characteristic in which the output power is inversely proportional to the load.

Another object of this invention is to instantly start in any order the multi-parallel configured gas discharge lamps.

A further object of this invention is to balance the output current. This permits increasing the resonant frequency of the inverter to values higher than 50 Khz while maintaining a low crest factor and high efficiency. Increasing the frequency reduces the values of the transformer and the ballasting inductor and capacitors. Increasing the frequency also results in improved performance and reduced cost.

A still further object of this invention is to improve the reliability of the ballast with a means to avoid the common conduction and high voltage transient.

A still further object of this invention is to reduce the flicker when the power to the ballast is turned off.

Additional objects and advantages of the invention will be set forth in part in the description that follows, and in part will be obvious from the description, or may be learned by practice of invention. The objects and advantages of the invention may be realized and attained by means of the instrumentalities and combinations pointed out in the appended claims.

To achieve the objects and in accordance with the purposes of the invention, as embodied and broadly described herein, this invention comprises a ballast for starting at least one gas discharge lamp, the ballast being composed of:

- a DC voltage input terminal device for receiving DC power from an external power supply;
- an inverter device, coupled to the input terminal device, for generating and outputting an alternating output voltage based on the DC power from the input terminal device;
- a transformer device, coupled to the inverter device, for transferring the alternating output voltage output by the inverter device to the at least one gas discharge lamp; and
- a ballasting device, coupled to the transformer device and the at least one gas discharge lamp, for limiting the lamp current output by the at least one gas discharge lamp that is passed back to the transformer device.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF THE PREFERRED EMBODIMENT

Figure 1:
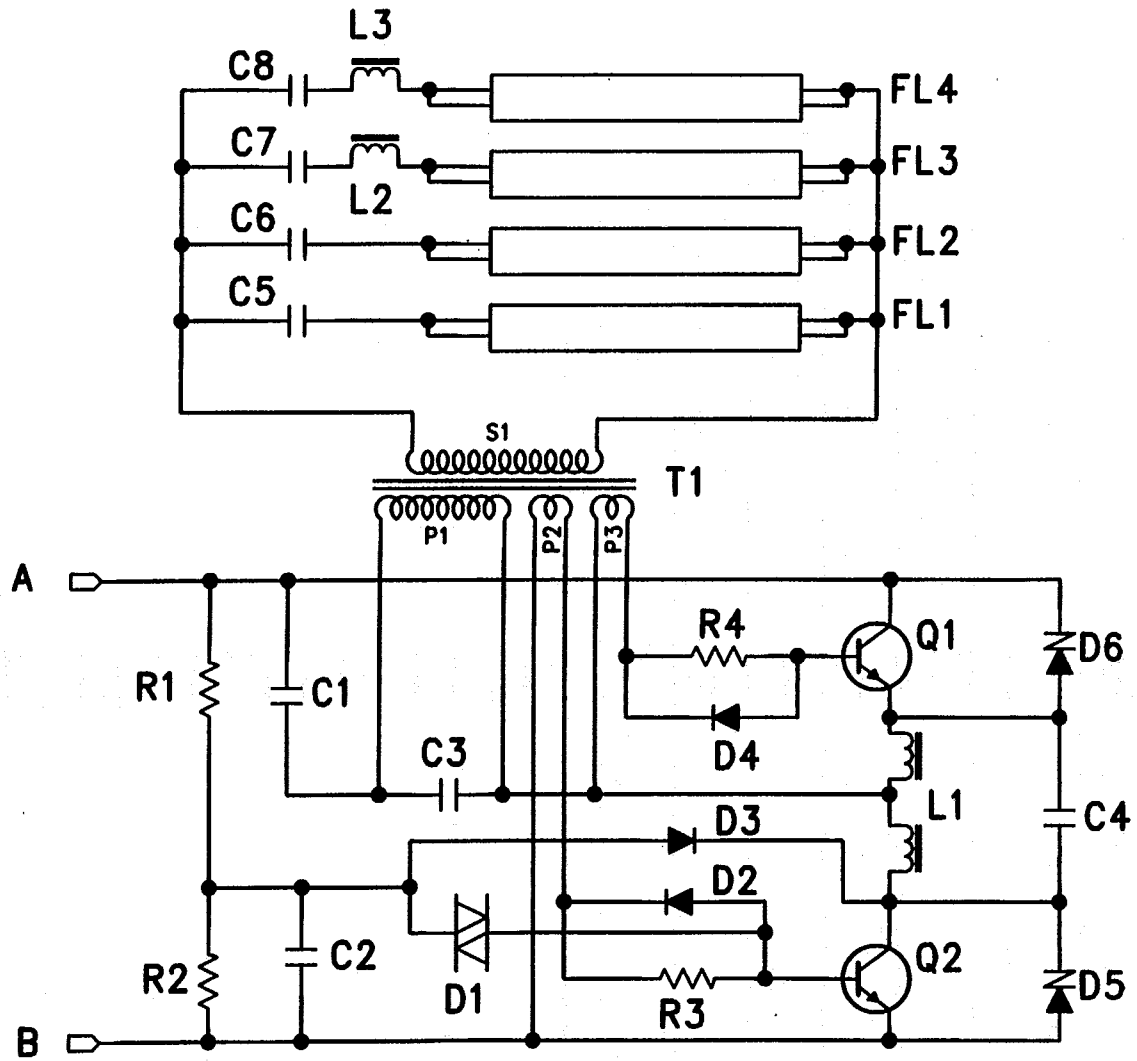
FIG. 1 is a detailed circuit diagram of an electronic ballast for instant start gas discharge lamps in accordance with a preferred embodiment of the present invention.

Reference will now be made in detail to the present preferred embodiments of the invention, examples of which are illustrated in the accompanying drawings in which like reference characters refer to corresponding elements.

FIG. 1 illustrates the detailed circuit diagram of the invention. The positive and negative input terminals A and B are provided as a means to input a DC voltage to the circuit. The input terminals are connected to an external power supply (not shown) to receive the DC voltage, and to transfer the voltage to an inverter.

The inverter in accordance with the present invention has a capacitor C1 which is a DC balance (blocking) capacitor that serves as a second DC voltage source. When a DC voltage is applied to terminals A and B, capacitor C2 is charged through resistors R1 and R2. Until Vc2 (voltage across capacitor C2) reaches the break down voltage of DIAC D1, the discharge current from C2 is applied to transistor Q2, and Q2 is turned on (conductive). When Q2 is on, a current from terminal A passes through C1, Tank Circuit I (C3 and output transformer winding P1), Tank Circuit II (L1 and C4), Q2, and, finally, exiting through terminal B.

When a current passes through Tank Circuit I (TCI), a voltage is induced in winding P2 which maintains transistor Q2 in the on state. The current in TCI will switch polarity after one half cycle at the resonant frequency. When the current in P1 again reverses polarity, a negative voltage is induced in winding P2 turning off transistor Q2, and a positive voltage is induced in winding P3 turning on transistor Q 1. With the circuit in this state, the starting voltage source Vc2 (voltage across capacitor C2) charges TCI through transistor Q1, and Tank Circuit II (TCII). Vp2 (voltage across winding P2) will keep transistor Q2 off, and Vp3 (voltage across winding P3) will keep transistor Q 1 on until the current in winding P1 reverses polarity. This oscillation cycle will keep going until power is removed from terminals A and B.

In FIG. 1, the purpose of diode D3 is to prevent capacitor C2 from being charged during the oscillation cycle. The purpose of diodes D2 and D4 is to reduce the time required to discharge the base current of transistors Q 1 and Q2.

In order to instantly start several gas discharge lamps, all the lamps should be connected in parallel to the inverter's output. Otherwise, the inverter must produce an unreasonably high output voltage. If the inverter uses a current-fed parallel resonant output stage, a current source or quasi-current source is needed to drive the inverter. In such an inverter, an increase in the load impedance results in an increase in the power supplied to the load. Therefore, when one lamp is removed, increasing the load impedance, the load draws more power causing the lamp brightness to increase and reducing the effective lifetime of the lamps.

Figure 2:
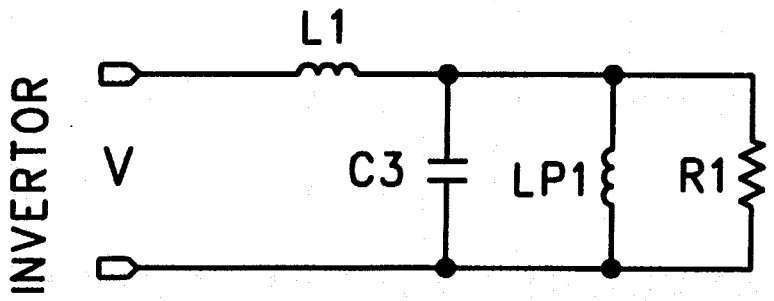
FIG. 2 is an equivalent circuit diagram for the output stage of the electronic ballast for instant start gas discharge lamps in accordance with a preferred embodiment of the present invention.

FIG.2 illustrates an equivalent circuit for a quasi-voltage source driven, parallel resonant circuit. Here V is a voltage source, L1 is an AC blocking inductor, C3 and Lp1 (which is the primary winding of the output transformer T2) together form Tank Circuit I (TCI), and R1 is the load. When the inductance of L1 is chosen to be small, the power requirements of the load (i.e., the lamps) will be inversely proportional to the load impedance. Thus, when one lamp is removed causing the load impedance to increase, the power drawn by the lamps is reduced. Because of inductor L1, a quasi-voltage source driven parallel resonant circuit normally has a low quality factor, Q. A low Q is a disadvantage for parallel load (i.e., parallel lamp) arrangements, which need a high Q to maintain a high output voltage for starting the lamps. To obtain a high Q, a second resonant circuit TCII has been introduced into the circuit design. The resonant frequency of TCII is chosen to be higher than the switching frequency, $f_{sw}$. Then, at $f_{sw}$, the impedance of TCII is higher than the impedance of inductor L1. For example, when the frequency of TCII is two times higher than $f_{sw}$, the impedance of TCII is four times higher than the impedance of inductor L1 at $f_{sw}$. Consequently, a high Q, quasi-voltage source is produced.

In a switching inverter, one serious problem is common conduction, i.e., the momentary simultaneous conduction of the switching transistors. When common conduction occurs, the DC bus is shorted by the switching transistors, a large current flows through both transistors, and the transistors are destroyed. To avoid common conduction, a programmable dead time has been provided in this invention. By adjusting the value of the capacitor C4, the time for current to begin flowing through a switching transistor can be adjusted. Therefore, by choosing the proper value for C4 (about 750 pF), the current flow can be delayed until after the common conduction period is over, thus, protecting the switching transistors Q1 and Q2 from common conduction damage. In FIG. 1, D5 and D6 are fast recovery transient voltage suppressors. In the normal operating mode, D5 and D6 work like forward conducting flywheel diodes. They will suppress any high voltage transient. Since D5 and D6 are in parallel with Q1 and Q2, Q1 and Q2 are well protected. This feature improves the reliability of the ballast.

In FIG. 1, resistor R2 has been incorporated into the circuit in series with R1 to form a voltage divider for charging C2. The advantage of this construction is to reduce flicker when the AC power to the ballast is turned off. After power is removed, the voltage across terminals A and B decays. During this decay, the inverter stops oscillating. Without R2 the voltage across C2 can rise to the breakdown voltage of DIAC D 1, thereby retriggering the inverter and resulting in flicker. With R2, the voltage across C2 cannot reach the level required to trigger the inverter.

In FIG. 1, the output section of the ballast includes output transformer T1, ballasting components C5, C6 (capacitors), L2, L3 (inductor), and DC blocking capacitors C7 and C8. After starting the lamps, the currents through the lamps FL1 and FL2 are out of phase with the currents through the lamps FL3 and FL4. Only the real part of the lamp current passes through the output transformer T1. Consequently, the VA rating of the output transformer T1 is small, resulting in a small physical size, making it inexpensive to produce. This design of the output stage of the ballast also allows a high operating frequency (over 50 Khz) while maintaining a low crest factor and high efficiency. Increasing the frequency reduces the values of the transformer and the ballast inductor and capacitors. Increasing the frequency also improves the performance and reduces the cost of the ballast.

Although the present invention has been described in detail with reference to the accompanying drawings, it should be understood that the description and drawings are provided for illustrative purposes only. The description and drawings should not be construed as limiting any aspect or advantage of the present invention. Instead, various modifications to the preferred embodiment should be readily apparent to those skilled in the art without departing from the spirit and scope of the present invention.

For example, the inverter of the present invention is not limited to use in the ballasting circuit. It may be used in any setting where a reliable conversion of DC power to AC is required. In addition, it should be noted that the ballasting circuit described above is not limited to the configuration of a capacitor branch and inductor branch in parallel. Any means that would limit or cancel the imaginary current flowing out of the discharge lamps would be equivalent to that shown and described above. It should also be noted that, although it is preferred that the inverter described herein be used with the ballasting circuit of the present invention, the ballasting circuit could be used independently of the specific inverter described herein. The invention therefore should only be limited by the following claims appended hereto.

What is claimed is:

1. A ballast for starting at least one gas discharge lamp, the ballast comprising:

a DC voltage input terminal means for receiving DC power from an external power supply;

an inverter means, coupled to said input terminal means, for generating and outputting an alternating output voltage based on the DC power from said input terminal means;

a transformer means, coupled to said inverter means, for transferring the alternating output voltage output by said inverter means to the at least one gas discharge lamp; and a ballasting means, coupled to said transformer means and the at least one gas discharge lamp, for limiting imaginary lamp current that is passed back to said transformer means from the at least one gas discharge lamp, said ballasting means including a secondary voltage source coupled to said input terminal means for providing a source voltage, a first resonating section for receiving output from said secondary voltage source and providing an output voltage based on a first resonating frequency, a switching means for receiving the output voltage from said first resonating section and alternating the polarity of the output voltage for output to said transformer means, and an oscillating enabling circuit, coupled to said switching means, for enabling oscillation of said first resonating section.

2. The ballast of claim 1, wherein said inverter means further comprises a second resonating section, coupled to said first resonating section, for resonating at a second resonating frequency, which is higher than said first resonating frequency.

3. The ballast of claim 2, wherein said switching means comprises:

a first transistor having an emitter coupled to said second resonating section and a collector connected to said input terminal means; and a second transistor having an emitter coupled to said input terminal means and a collector coupled to said second resonating section; and wherein said inverter means further comprises:

a first base current drive circuit, coupled to the base of said first transistor, for activating said first transistor; and a second base current drive circuit, coupled to the base of said second transistor, for activating said second transistor.

4. The ballast of claim 3, wherein said transformer means comprises:

a primary winding for receiving an alternating output voltage from said first resonating section;

a secondary winding for transferring the alternating output voltage from said primary winding and outputting a corresponding voltage to the at least one discharge lamp to be started;

a third winding, coupled to said second base current drive circuit, for activating said second transistor in response to a current induced by said primary winding; and a fourth winding, coupled to said first base current drive circuit, for activating said first transistor in response to a current induced by said third winding.

5. The ballast of claim 4, wherein said first resonating section comprises a capacitor coupled to said primary winding of said transformer means.

6. The ballast of claim 2, wherein said second resonating section comprises a center-tapped inductor in parallel with a capacitor.

7. The ballast of claim 1, wherein said oscillating enabling circuit comprises:

a pair of resistors connected in series;

a capacitor connected in parallel with one of said pair of resistors; and a DIAC having a first end connected in parallel with said capacitor and a second end connected to the base of said second transistor.

8. The ballast of claim 1, wherein said secondary voltage source is a capacitor coupled to said input terminal means.

9. The ballast of claim 3, wherein said first base current drive circuit comprises a diode having a first end connected to said fourth winding of said transformer means and a second end connected to the base of said first transistor, and a resistor in parallel with said diode; and wherein said second base current drive circuit comprises a diode having a first end connected to said third winding of said transformer means and a second end connected to the base of said second transistor, and a resistor in parallel with said diode.

10. The ballast of claim 3, wherein said switching means further comprises:

a first voltage suppressor, connected in parallel with said first transistor, for operating as a conducting flywheel diode and as a transient voltage suppressor; and a second voltage suppressor, connected in parallel with said second transistor, for operating as a conducting flywheel diode and as a transient voltage suppressor.

11. A ballast for starting at least one gas discharge lamp, the ballast comprising:

a DC voltage input terminal means for receiving DC power from an external power supply;

an inverter means, coupled to said input terminal means, for generating and outputting an alternating output voltage based on the DC power from said input terminal means;

a transformer means, coupled to said inverter means, for transferring the alternating output voltage output by said inverter means to the at least one gas discharge lamp; and a ballasting means, coupled to said transformer means and the at least one gas discharge lamp, for limiting imaginary lamp current that is passed back to said transformer means from the at least one gas discharge lamp, said ballasting means including a secondary voltage source coupled to said input terminal means for providing a source voltage, a first resonating section for receiving output from said secondary voltage source and providing an output voltage based on a first resonating frequency, a switching means for receiving the output voltage from said first resonating section and alternating the polarity of the output voltage for output to said transformer means, and an oscillating enabling circuit, coupled to said switching means, for enabling oscillation of said first resonating section, said ballasting means including a first branch circuit having a capacitor whose first end is coupled to said transformer means and whose second end is coupled to a first gas discharge lamp to be started, and a second branch circuit having an inductor whose first end is coupled to said transformer means and whose second end is coupled to a second gas discharge lamp to be started.

12. The ballast of claim 11, wherein said second branch circuit further comprises a DC blocking capacitor connected to said transformer means and said indicator.

13. The ballast of claim 2, wherein said inverter means has a resonant frequency higher than 50 KHz.

14. A ballast circuit for starting a plurality of gas discharge lamps connected in parallel to a power source, wherein a discharge current having imaginary and real components is output from each of said gas discharge lamps and input to said power source, the ballast circuit comprising:

a first impedance having a first end connected to one of said plurality of gas discharge lamps, and a second end connected to said power source; and a second impedance having a first end connected to another one of said plurality of gas discharge lamps, and a second end connected to said power source, wherein the imaginary current output from said discharge lamps is limited by said first and second impedances before being input to said power source.

15. The ballasting circuit of claim 14, wherein said first impedance is a capacitor and said second impedance is an inductor.

16. An inverter for receiving DC power from an external source and outputting AC power to a transformer, the inverter comprising:

a secondary voltage source coupled to the external source for providing a source voltage;

a first resonating section for receiving output from said secondary voltage source and providing an output voltage based on a first resonating frequency;

a switching circuit for receiving the output voltage from said first resonating section and alternating the polarity of the output voltage for output to the transformer; and an oscillating enabling circuit, coupled to said switching circuit, for enabling oscillation of said first resonating section; and a second resonating section, coupled to said first resonating section, for resonating at a second resonating frequency, which is higher than said first resonating frequency.

17. The inverter of claim 16, wherein said switching circuit comprises:

a first transistor having an emitter coupled to said second resonating section and a collector connected to the external source; and a second transistor having an emitter coupled to the external source and a collector coupled to said second resonating section; and wherein the inverter further comprises:

a first base current drive circuit, coupled to the base of said first transistor, for activating said first transistor; and a second base current drive circuit, coupled to the base of said second transistor, for activating said second transistor.

18. The inverter of claim 17, wherein the transformer comprises:

a primary winding for receiving an alternating output voltage from said first resonating section;

a secondary winding for transferring the alternating output voltage from said primary winding and outputting a corresponding voltage to the at least one discharge lamp to be started;

a third winding, coupled to said second base current drive circuit, for activating said second transistor in response to a current induced by said primary winding; and a fourth winding, coupled to said first base current drive circuit, for activating said first transistor in response to a current induced by said third winding; and wherein said first resonating section comprises a capacitor coupled to said primary winding of the transformer, said second resonating section comprises a center-tapped inductor in parallel with a capacitor, and said oscillating enabling circuit comprises:

a pair of resistors connected in series;

a capacitor connected in parallel with one of said pair of resistors; and a DIAC having a first end connected in parallel with said capacitor and a second end connected to the base of said second transistor.

19. The inverter of claim 18, wherein said first base current drive circuit comprises a diode having a first end connected to said fourth winding of the transformer and a second end connected to the base of said first transistor, and a resistor in parallel with said diode; and wherein said second base current drive circuit comprises a diode having a first end connected to said third winding of the transformer and a second end connected to the base of said second transistor, and a resistor in parallel with said diode, and said switching circuit further comprises:

a first voltage suppressor, connected in parallel with said first transistor, for operating as a conducting flywheel diode and as a transient voltage suppressor; and a second voltage suppressor, connected in parallel with said second transistor, for operating as a conducting flywheel diode and as a transient voltage suppressor.

* * * * *

UNITED STATES PATENT AND TRADEMARK OFFICE

CERTIFICATE OF CORRECTION

PATENT NO. : 5,438,243

DATED : August 1, 1995

INVENTOR(S) : Qin Kong

It is certified that error appears in the above-indentified patent and that said Letters Patent is hereby corrected as shown below:

On the title page, please delete the name of the inventor [Oin Kong] and insert therefor: -- Qin Kong --.

Signed and Sealed this

Twenty-eighth Day of November 1995

*Attest:*

Bruce Lehman

BRUCE LEHMAN

*Attesting Officer*

*Commissioner of Patents and Trademarks*